US009058017B2

(12) United States Patent
Lee et al.

(10) Patent No.: US 9,058,017 B2
(45) Date of Patent: Jun. 16, 2015

(54) ELECTROPHOTOGRAPHIC IMAGE FORMING APPARATUS AND DEVELOPMENT CARTRIDGE

(71) Applicant: SAMSUNG ELECTRONICS CO., LTD., Suwon-si, Gyeonggi-do (KR)

(72) Inventors: Dong-geun Lee, Suwon-si (KR); Sung-jin Kim, Suwon-si (KR); Yong-Il Moon, Seoul (KR); Ji-won Moon, Suwon-si (KR); Seung-chan Park, Hwaseong-si (KR); Hyung-seok Chang, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/029,172

(22) Filed: Sep. 17, 2013

(65) Prior Publication Data

US 2014/0205316 A1 Jul. 24, 2014

Related U.S. Application Data

(60) Provisional application No. 61/756,269, filed on Jan. 24, 2013, provisional application No. 61/758,965, filed on Jan. 31, 2013.

(30) Foreign Application Priority Data

Apr. 23, 2013 (KR) ..... 10-2013-0045045

(51) Int. Cl.
*G03G 21/18* (2006.01)
*G03G 21/16* (2006.01)

(52) U.S. Cl.
CPC ..... *G03G 21/1839* (2013.01); *G03G 21/1633* (2013.01); *G03G 21/1647* (2013.01); *G03G 21/1821* (2013.01)

(58) Field of Classification Search
None
See application file for complete search history.

(56) References Cited

U.S. PATENT DOCUMENTS

| | | | | |
|---|---|---|---|---|
| 5,160,964 | A | 11/1992 | Takahashi et al. | |
| 6,654,581 | B2 | 11/2003 | Liu et al. | |
| 7,616,907 | B2 * | 11/2009 | Kim et al. | 399/25 |
| 8,121,518 | B2 | 2/2012 | Sato | |
| 8,457,525 | B2 | 6/2013 | Kamimura | |

(Continued)

FOREIGN PATENT DOCUMENTS

| | | |
|---|---|---|
| EP | 1806634 A1 | 7/2007 |
| JP | 2009-181018 | 8/2009 |

(Continued)

OTHER PUBLICATIONS

Extended European Search Report mailed Jun. 12, 2014 in related European Application No. 13196416.5.

(Continued)

*Primary Examiner* — Clayton E Laballe
*Assistant Examiner* — Jas Sanghera
(74) *Attorney, Agent, or Firm* — Staas & Halsey LLP

(57) ABSTRACT

An electrophotographic image forming apparatus and development cartridge are provided. The apparatus including a separating member mounted in a development cartridge. The separating member includes a development nip separating portion and a charging nip separating portion respectively separating a development nip and a charging nip when the development cartridge is mounted in a mounting portion of a photoreceptor cartridge mounted in a body.

10 Claims, 13 Drawing Sheets

(56) References Cited

U.S. PATENT DOCUMENTS

| | | | | |
|---|---|---|---|---|
| 2003/0049046 | A1 | 3/2003 | Okabe | |
| 2004/0096240 | A1 | 5/2004 | Kim | |
| 2005/0002682 | A1 | 1/2005 | Lyu et al. | |
| 2005/0111881 | A1 | 5/2005 | Arimitsu et al. | |
| 2005/0191090 | A1* | 9/2005 | Nishimura | 399/113 |
| 2006/0257163 | A1 | 11/2006 | Sato | |
| 2007/0071496 | A1 | 3/2007 | Lee | |
| 2007/0147887 | A1 | 6/2007 | Hattori | |
| 2009/0067877 | A1* | 3/2009 | Terai | 399/111 |
| 2011/0064461 | A1 | 3/2011 | Ishii et al. | |
| 2011/0091222 | A1 | 4/2011 | Kim et al. | |
| 2011/0206410 | A1 | 8/2011 | Okabe | |
| 2014/0037330 | A1 | 2/2014 | Hiramatsu et al. | |

FOREIGN PATENT DOCUMENTS

| | | |
|---|---|---|
| JP | 2009-244555 | 10/2009 |
| JP | 2010-266893 | 11/2010 |
| JP | 2011-22616 | 2/2011 |
| JP | 2011-65185 | 3/2011 |
| JP | 4743199 | 5/2011 |
| JP | 2012-42725 | 3/2012 |
| KR | 10-2007-0087738 | 8/2007 |
| KR | 10-2011-0071440 | 6/2011 |
| KR | 10-1066103 | 9/2011 |

OTHER PUBLICATIONS

European Office Action mailed Apr. 29, 2014 in related European Application No. 1317061.9.

European Office Action mailed Apr. 28, 2014 in related European Application No. 13170028.8.

Office Action mailed Aug. 6, 2014 in related U.S. Appl. No. 14/021,518.

Office Action mailed Jul. 14, 2014 in related U.S. Appl. No. 13/906,582.

European Search Report mailed Sep. 4, 2013 in related European Application No. 13170028.8.

European Office Action mailed Sep. 30, 2013 in related European Application No. 13170028.8.

European Search Report mailed Sep. 4, 2013 in related European Application No. 13170061.9.

European Office Action mailed Sep. 30 in related European Application No. 13170061.9.

Korean Notice of Allowance mailed Sep. 22, 2014 in related Korean Application No. 10-2013-0045046.

Korean Notice of Allowance mailed Sep. 22, 2014 in related Korean Application No. 10-2013-0045047.

European Office Action mailed Oct. 30, 2014 in related European Application No. 13170061.9.

Office Action mailed Dec. 22, 2014 in related U.S. Appl. No. 14/014,626.

Office Action mailed Dec. 1, 2014 in related U.S. Appl. No. 13/906,587.

Office Action mailed Nov. 20, 2014 in related U.S. Appl. No. 14/021,518.

Office Action mailed Dec. 5, 2014 in related U.S. Appl. No. 14/021,518.

Notice of Allowance mailed Jan. 14, 2015 in related U.S. Appl. No. 13/906,582.

European Official Communication issued Mar. 10, 2015 in corresponding European Patent Application No. 13170028.8.

* cited by examiner

ELECTROPHOTOGRAPHIC IMAGE FORMING APPARATUS AND DEVELOPMENT CARTRIDGE

CROSS-REFERENCE TO RELATED APPLICATIONS

This application is related to, and claims priority to, U.S. Provisional Application No. 61/756,269, filed on Jan. 24, 2013 and U.S. Provisional Application No. 61/758,965, filed on Jan. 31, 2013, in the U.S. Patent and Trademark office, and Korean Patent Application No. 10-2013-0045045, filed on Apr. 23, 2013, in the Korean Intellectual Property Office, the disclosures of which are incorporated herein by reference.

BACKGROUND

1. Field

Exemplary embodiments of the present invention relate to an electrophotographic image forming apparatus capable of individually replacing a photoreceptor cartridge and a development cartridge.

2. Description of the Related Art

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

A process cartridge is an assembly of components for forming a visible toner image, and is a consumable product that is detachable from a body of an image forming apparatus and replaceable after a life is ended. An integrated process cartridge includes a photoreceptor and contains toner to be supplied to the photoreceptor. However, an amount (life) of toner included in the integrated process cartridge may be shorter than a life of the photoreceptor. Since a life of the integrated process cartridge may be dependent upon the amount of toner contained therein, after the toner is all used up, the integrated process cartridge has to be replaced even if the life of the photoreceptor has not expired, thereby increasing consumable product costs for a user.

In order to reduce consumable product costs, a separable process cartridge has been designed so that a photoreceptor cartridge including a photoreceptor and a development cartridge containing toner are individually replaced.

SUMMARY

Additional aspects and/or advantages will be set forth in part in the description which follows and, in part, will be apparent from the description, or may be learned by practice of the invention.

Exemplary embodiments of the present invention provide an electrophotographic image forming apparatus capable of individually attaching/detaching a photoreceptor cartridge and a development cartridge to/from a body, wherein a charging nip formed by a photoconductive drum and a charging roller and a development nip formed by the photoconductive drum and a development roller are simultaneously separable.

According to an aspect of the present invention, an electrophotographic image forming apparatus is provided including a body including an opening, a photoreceptor cartridge attached to, or detached from, the body through the opening, and including a mounting portion, a photoconductive drum, and a charging roller, wherein the photoconductive drum and the charging roller form a charging nip by contacting each other, a development cartridge attached to, or detached from, the mounting portion through the opening while the photoreceptor cartridge is mounted in the body, and including a development roller forming a development nip by contacting the photoconductive drum, a cover for opening or closing the opening, and fixing the development cartridge to the mounting portion by pressurizing the development roller while the opening is closed, and a separating member mounted on the development cartridge, and including a development nip separating portion and a charging nip separating portion respectively separating the development nip and the charging nip while the development cartridge is mounted in the mounting portion.

The development cartridge may- include a gap maintaining member for constraining the development nip by contacting the photoconductive drum, wherein the development nip separating portion may be disposed in front of the gap maintaining member and may be disposed between the photoconductive drum and the gap maintaining member when the development cartridge is mounted in the mounting portion.

The charging nip separating portion may be inserted between a rotation shaft of the charging roller and the photoconductive drum to separate the charging roller from the photoconductive drum when the development cartridge is mounted in the mounting portion.

The electrophotographic image forming apparatus may include a shaft supporting member for rotatably supporting the charging roller with respect to a frame of the photoreceptor cartridge, wherein the charging nip separating portion may be inserted between the shaft supporting member and the photoconductive drum to separate the charging roller from the photoconductive drum when the development cartridge is mounted in the mounting portion.

The separating member may include a combining portion separably combined to a housing of the development cartridge.

The separating member may include a handle for a user to hold.

According to an aspect of the present invention, a development cartridge is provided that is mounted in a mounting portion of a photoreceptor cartridge comprising a photoconductive drum and a charging roller, which form a charging nip by contacting each other, while the photoreceptor cartridge is mounted in a body of an image forming apparatus, the development cartridge including: a housing, a development roller rotatably supported by the housing and forming a development nip by contacting the photoconductive drum while the development cartridge is mounted in the mounting portion, and a separating member including a combining portion combined to the housing, and a development nip separating portion and a charging nip separating portion respectively separating the development nip and the charging nip when the development cartridge is mounted in the mounting portion.

The development cartridge may include a gap maintaining member for constraining the development nip by contacting the photoconductive drum, and the development nip separating portion may be disposed in front of the gap maintaining member and may be disposed between the photoconductive drum and the gap maintaining member when the development cartridge is mounted in the mounting portion.

The charging nip separating portion may be inserted between a rotation shaft of the charging roller and the photoconductive drum to separate the charging roller from the photoconductive drum when the development cartridge is mounted in the mounting portion.

The charging nip separating portion may be inserted between the photoconductive drum and a shaft supporting member that rotatably supports the charging roller with respect to a frame of the photoreceptor cartridge when the development cartridge is mounted in the mounting portion to separate the charging roller from the photoconductive drum.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
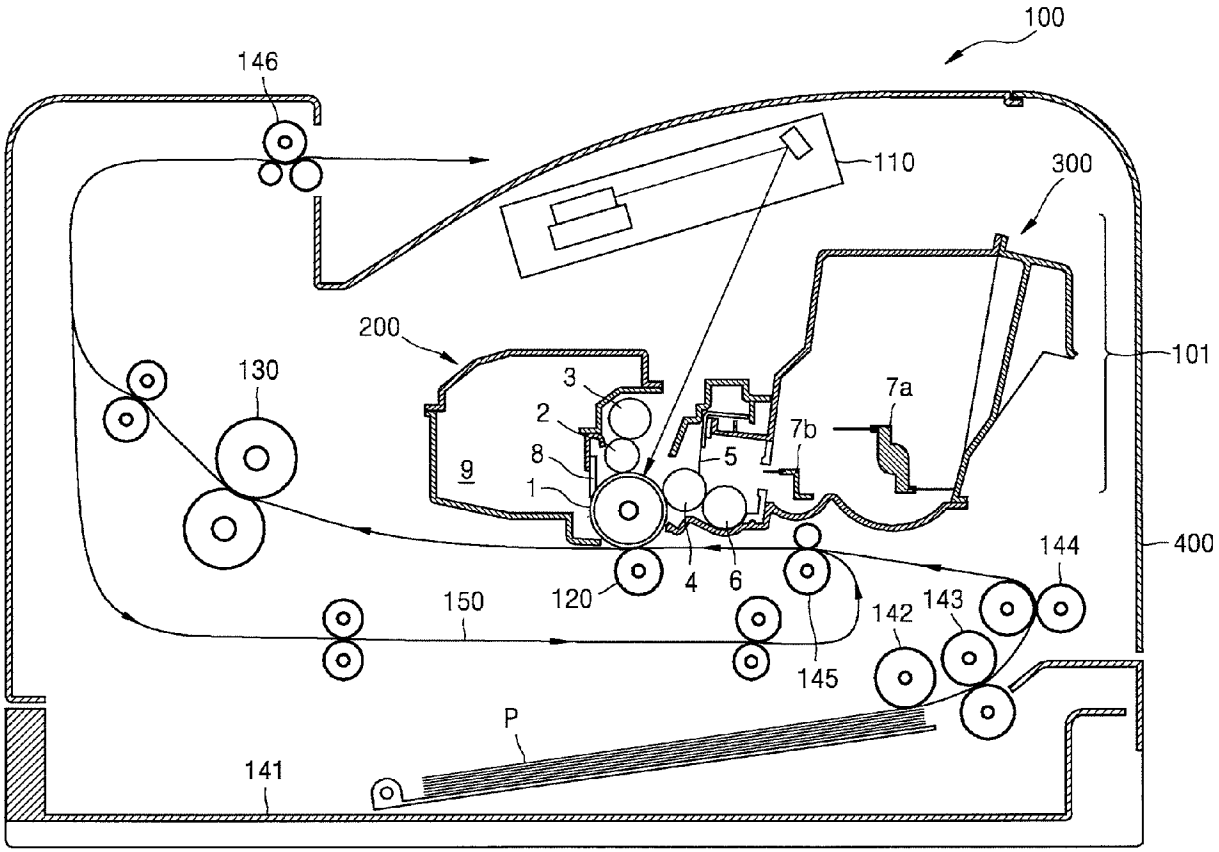
FIG. 1 is a schematic view of an electrophotographic image forming apparatus according to an embodiment of the present invention.

Exemplary embodiments of the present invention are described with reference to the accompanying drawings, in which exemplary embodiments of the present invention are illustrated. In the drawings, like reference numerals denote like elements.

Figure 2A:
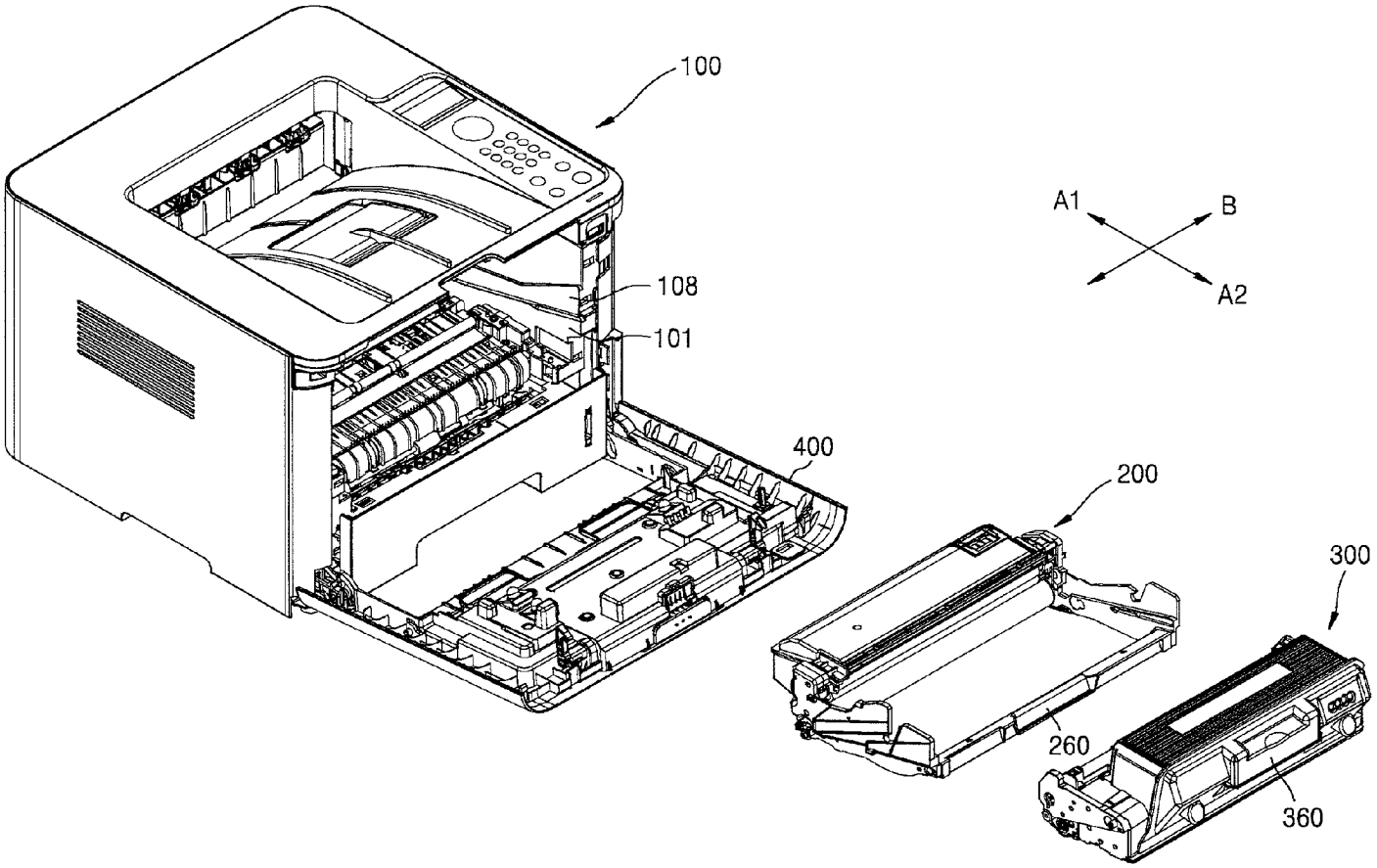
FIG. 2A is a schematic perspective view of an electrophotographic image forming apparatus, wherein a photoreceptor cartridge and a development cartridge are removed from a body, according to an embodiment of the present invention.
Figure 2B:
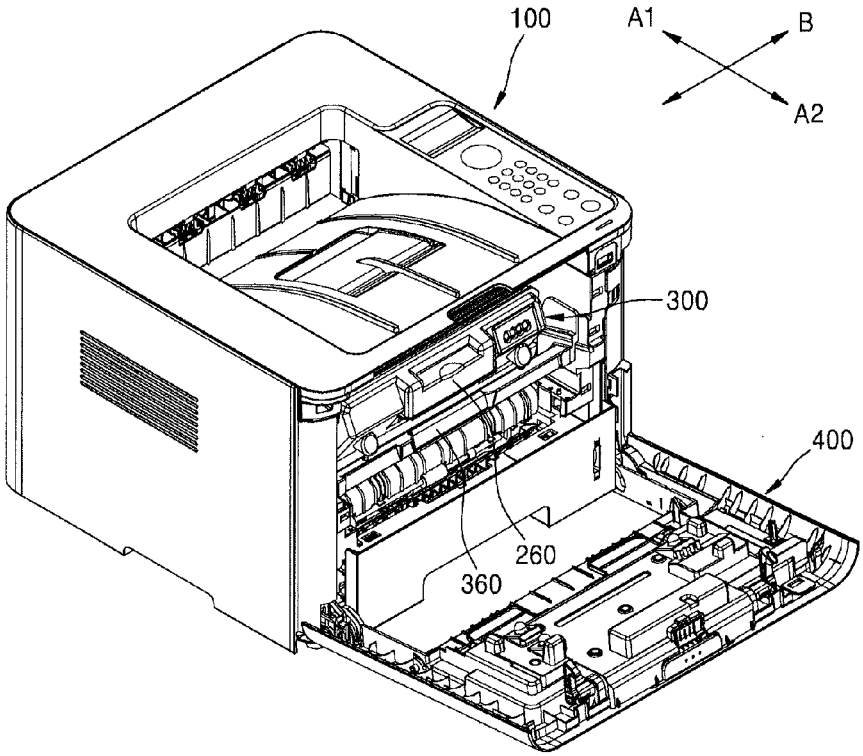
FIG. 2B is a schematic perspective view of an electrophotographic image forming apparatus, wherein a photoreceptor cartridge and a development cartridge are mounted in a body, according to an embodiment of the present invention.

FIG. 1 is a schematic view of an electrophotographic image forming apparatus according to an embodiment of the present invention. FIGS. 2A and 2B are schematic perspective views of a electrophotographic image forming apparatus, wherein a photoreceptor cartridge 200 and a development cartridge 300 are removed from a body 100 in FIG. 2A and the photoreceptor cartridge 200 and the development cartridge 300 are mounted in the body 100 in FIG. 2B.

Referring to FIGS. 1, 2A, and 2B, the body 100, the photoreceptor cartridge 200, and the development cartridge 300 are illustrated. The body 100 includes an opening 101 providing a passage for the photoreceptor cartridge 200 and the development cartridge 300 to be mounted or removed. A cover 400 closes or opens the opening 101. The body 100 includes an exposure unit 110, a transfer roller 120, and a fusing unit 130. The body 100 includes a recording medium transfer structure for loading and transferring a recording medium P where an image is to be formed.

The photoreceptor cartridge 200 includes a photoconductive drum 1. The photoconductive drum 1 is an example of a photoreceptor, wherein an electrostatic latent image is formed on a surface thereof, and may include a conductive metal pipe and a photosensitive layer around the conductive metal pipe. A charging roller 2 is an example of a charger for charging the photoconductive drum 1 to have uniform surface potential.

Figure 3A:
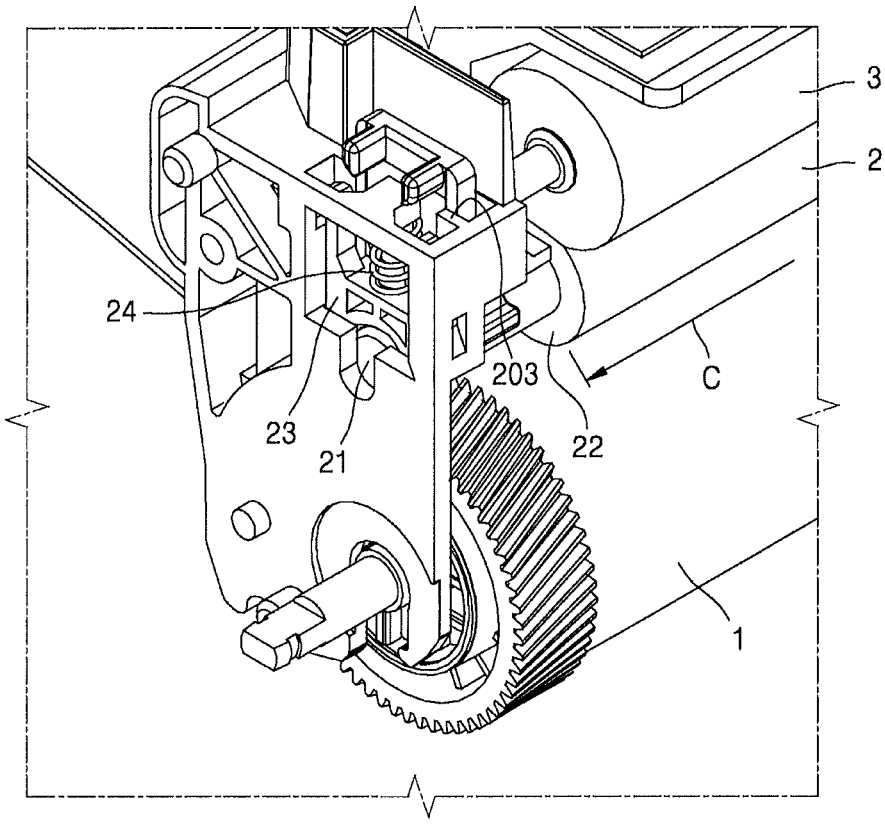
FIG. 3A is a diagram of an exemplary arrangement of a charging roller and a photoconductive drum.

FIG. 3A is a diagram of an exemplary arrangement of the charging roller 2 and the photoconductive drum 1. Referring to FIG. 3A, the charging roller 2 rotates while forming a charging nip C by contacting the photoconductive drum 1. The charging roller 2 may include, for example, a rotation shaft 21 formed of a metal, and a conductive rubber layer 22 disposed around the rotation shaft 21. A charge bias voltage for charging the photoconductive drum 1 may be applied through the rotation shaft 21. A shaft supporting member 23 is combined to both end portions of the rotation shaft 21. The shaft supporting member 23 may be, for example, a mold bearing or a sintering bearing containing oil. An elastic member 24 applies elastic force to the shaft supporting member 23 in a direction where the charging roller 2 contacts the photoconductive drum 1. The shaft supporting member 23 may be guided by a support portion 203 provided in a frame 202 of the photoreceptor cartridge 200. The charging roller 2 may contact the photoconductive drum 1 as the shaft supporting member 23 is guided by the support portion 203 and slides towards the photoconductive drum 1 by the elastic force of the elastic member 24.

A cleaning roller 3 may be included for removing foreign materials on a surface of the charging roller 2. A cleaning blade 8 is an example of a cleaning unit for removing toner and foreign materials on a surface of the photoconductive drum 1 after a transfer process. A cleaning apparatus having another shape, such as a rotating brush, may be used instead of the cleaning blade 8. The toner and foreign materials removed by the cleaning blade 8 may be included in a waste toner container 9.

The development cartridge 300 supplies toner included therein to an electrostatic latent image formed on the photoconductive drum 1 to develop the electrostatic latent image into a visible toner image. When a one-component development method is used, toner is included in the development cartridge 300, and when a two-component development method is used, toner and a carrier are included in the development cartridge 300. A development roller 4 is used to supply the toner in the development cartridge 300 to the photoconductive drum 1. A development bias voltage may be applied to the development roller 4. A regulator 5 constrains an amount of toner supplied from the development roller 4 to a development region where the photoconductive drum 1 and the development roller 4 face each other. The regulator 5 may be a doctor blade elastically contacting a surface of the development roller 4.

Figure 3B:
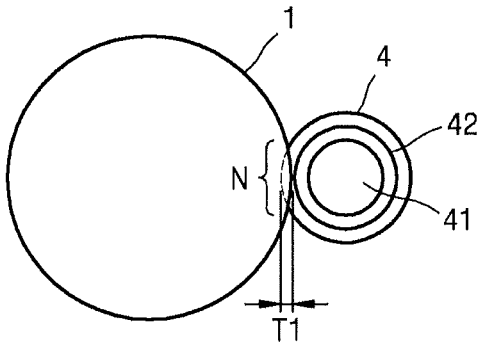
FIG. 3B is a diagram of an exemplary arrangement of a photoconductive drum and a development roller in a contact development method.

A contact type one-component development method according to an exemplary embodiment. FIG. 3B is a diagram of an exemplary arrangement of the photoconductive drum 1 and the development roller 4 in a contact development method. Referring to FIG. 3B, in the contact development method, gap maintaining member 42 having a smaller diameter than the development roller 4 may be provided on each of both ends of a rotation shaft 41 of the development roller 4. A contact amount of the development roller 4 to the photoconductive drum 1 may be constrained as the gap maintaining member 42 contacts the surface of the photoconductive drum 1. A development nip N may be formed as the development roller 4 contacts the photoconductive drum 1. The development cartridge 300 may further include a supply roller 6 for adhering the toner to the surface of the development roller 4. A supply bias voltage may be applied to the supply roller 6. The development cartridge 300 may include agitators 7*a* and 7*b*, as illustrated, for example, in FIG. 1, for stirring the toner and supplying the toner towards the supply roller 6 and the development roller 4. The agitators 7*a* and 7*b* may stir and triboelectrically charge the toner.

Examples of development methods of the electrophotographic image forming apparatus according to an embodiment have been described above, but the present invention is not limited thereto, and development methods may be variously modified and changed.

The exposure unit 110 forms the electrostatic latent image on the photoconductive drum 1 by irradiating light modulated according to image information to the photoconductive drum 1. The exposure unit 110 may be a laser scanning unit (LSU) using a laser diode as a light source, or a light-emitting diode (LED) exposure unit using an LED as a light source.

The transfer roller 120 is an example of a transfer unit for transferring a toner image from the photoconductive drum 1 to the recording medium P. A transfer bias voltage for transferring the toner image to the recording medium P may be applied to the transfer roller 120. A corona transfer unit or a transfer unit using a pin scorotron method may be used instead of the transfer roller 120.

The recording media P may be picked up one by one from a loading table 141 by a pickup roller 142, and may be transferred to a region where the photoconductive drum 1 and the transfer roller 120 face each other by feed rollers 143, 144, and 145.

The fusing unit 130 applies heat and pressure to an image transferred to the recording medium P so as to fuse the image on the recording medium P. The recording medium P that passed through the fusing unit 130 may be discharged outside the body 100 by a discharge roller 146.

According to an exemplary embodiment, the exposure unit 110 irradiates the light modulated according to the image information to the photoconductive drum 1 to develop the electrostatic latent image. The development roller 4 supplies the toner to the electrostatic latent image to form the visible toner image on the surface of the photoconductive drum 1. The recording medium loaded in the loading table 141 may be transferred to the region where the photoconductive drum 1 and the transfer roller 120 face each other by the pickup roller 142 and the feed rollers 143, 144, and 145, and the toner image is transferred on the recording medium P from the photoconductive drum 1 according to the transfer bias voltage applied to the transfer roller 120. After the recording medium P passes through the fusing unit 130, the toner image is fused on the recording medium P according to heat and pressure. After the fusing, the recording medium P is discharged by the discharge roller 146. When duplex printing is performed, after an imaged is printed on a front side of the recording medium P, the recording medium P may be re-transferred to the region where the photoconductive drum 1 and the transfer roller 120 face each other along a reverse transfer path 150 as the discharge roller 146 is reverse-rotated. A new toner image may be transferred to, and fused on, a rear side of the recording medium P. The recording medium P having duplex images may be discharged by the discharge roller 146.

The photoreceptor cartridge 200 and the development cartridge 300 are consumable products that are replaced after their lives are expired. Since lives of the photoreceptor cartridge 200 and the development cartridge 300 may be different, the photoreceptor cartridge 200 and the development cartridge 300 may be individually replaced.

A process cartridge, wherein the photoreceptor cartridge 200 and the development cartridge 300 may be combined to each other, may be mounted in or removed from the body 100. For example, when only the development cartridge 300 is to be replaced, the process cartridge may be removed from the body 100, the combination of the photoreceptor cartridge 200 and the development cartridge 300 is released, a new development cartridge 300 is combined to the photoreceptor cartridge 200, and the process cartridge may be mounted in the body 100. Accordingly, processes for replacing the development cartridge 300 are complex. Since a weight of the process cartridge may be heavy, it may be difficult to handle the process cartridge during mounting and removing processes.

According to an exemplary embodiment, the photoreceptor cartridge 200 may be mounted in the body 100, and the development cartridge 300 mounted in a mounting portion 201 provided in the photoreceptor cartridge 200. When removing the photoreceptor cartridge 200 and the development cartridge 300, the photoreceptor cartridge 200 may be removed from the body 100 after the development cartridge 300 is removed from the mounting portion 201. Accordingly, since the photoreceptor cartridge 200 and the development cartridge 300 may be individually mounted in, or removed from, the body 100, it may be easy to replace the photoreceptor cartridge 200 or the development cartridge 300. Since the photoreceptor cartridge 200 and the development cartridge 300 may be individually handled during the mounting and removing processes, user convenience may be improved as a burden of weights may be reduced.

Hereinafter, "front" is defined as a mounting direction A1 of the photoreceptor cartridge 200 and the development cartridge 300, and "rear" is defined as an opposite direction of the mounting direction A1, i.e., a removal direction A2.

Figure 4:
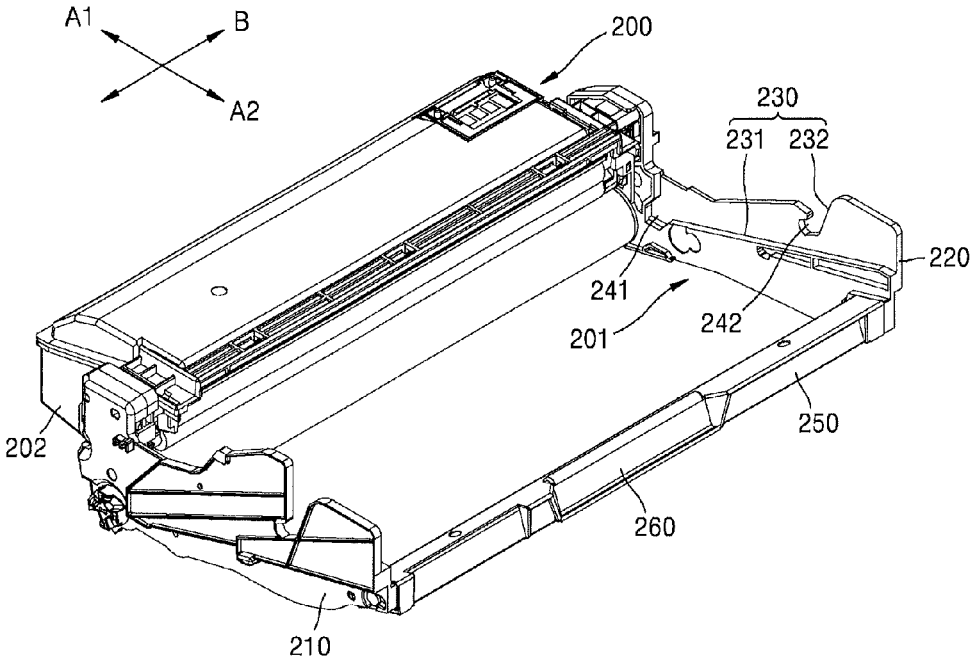
FIG. 4 is a perspective view of a photoreceptor cartridge according to an embodiment of the present invention.
Figure 5:
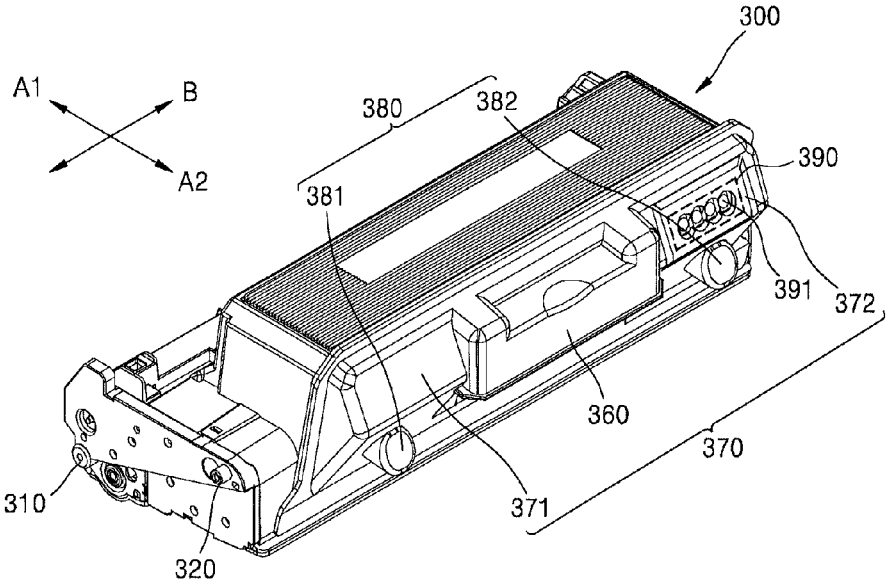
FIG. 5 is a perspective view of a development cartridge according to an embodiment of the present invention.

FIG. 4 is a perspective view of the photoreceptor cartridge 200 according to an embodiment of the present invention. FIG. 5 is a perspective view of the development cartridge 300 according to an embodiment of the present invention. Referring to FIGS. 4 and 5, the photoreceptor cartridge 200 includes the mounting portion 201 where the development cartridge 300 is mounted. The mounting portion 201 may include, for example, first and second guide members 210 and 220 extending backwards respectively from both side portions of a frame 202 of the photoreceptor cartridge 200. The first and second guide members 210 and 220 may be connected to each other by a connecting member 250 extending in a length direction B of the photoconductive drum 1. The connecting member 250 may be connected to rear ends of the first and second guide members 210 and 220. Guide rails 230 may be provided at inner walls of the first and second guide members 210 and 220. First and second guide protrusions 310 and 320 may be provided respectively on both side portions of the development cartridge 300. The second guide protrusion 320 may be disposed at a location spaced apart from the first guide protrusion 310 in backwards. The development cartridge 300 may be mounted in, or removed from, the mounting portion 201 as the first and second guide protrusions 310 and 320 are supported by the guide rail 230.

Figure 6:
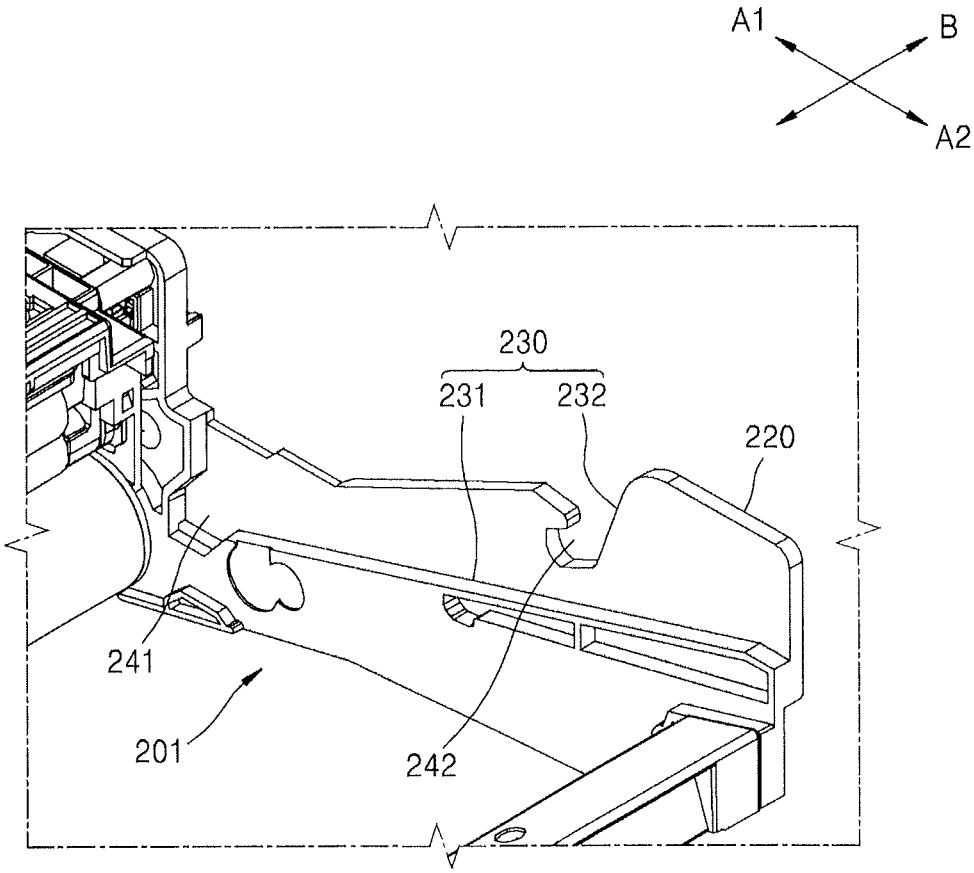
FIG. 6 is a perspective view of a guide rail, according to an embodiment of the present invention.

FIG. 6 is a perspective view of the guide rail 230, according to an embodiment of the present invention. Referring to FIG. 6, the guide rail 230 guides the first and second guide protrusions 310 and 320 respectively to first and second accommodation portions 241 and 242. The guide rail 230 may have a rib shape protruding inward from the inner walls of the first and second guide members 210 and 220. The first and second guide protrusions 310 and 320 may have a boss shape externally protruding respectively from the both side portions of the development cartridge 300. The guide rail 230 may include a first guide rail 231 for guiding the first guide protrusion 310 to the first accommodation portion 241, and a second guide rail 232 for guiding the second guide protrusion 320 to the second accommodation portion 242. The first accommodation portion 241 may have a shape, for example, a tilted U- or V-shape, such that the first guide protrusion 310 having a cylindrical shape may be inserted and accommodated therein. The second accommodation portion 242 may have a shape, for example, a lying U- or V-shape, such that the second guide protrusion 320 having a cylindrical shape is inserted and accommodated therein and does not leave from the second accommodation portion 242 upwardly. However, the shapes of the first and second accommodation portions 241 and 242 are not limited thereto.

Figure 7:
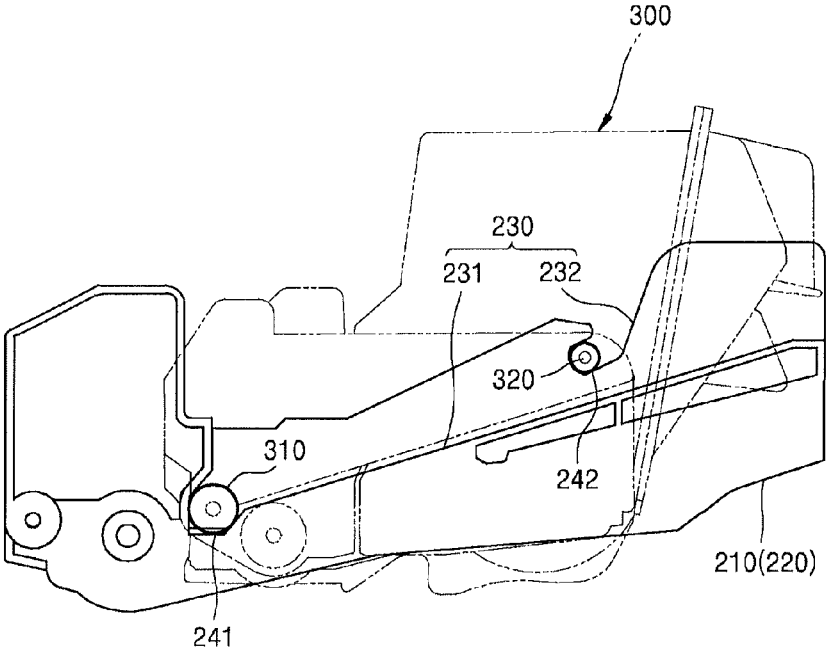
FIG. 7 is a schematic view illustrating a development cartridge mounted in a mounting portion after a photoreceptor cartridge is mounted in a body, according to an embodiment of the present invention.

FIG. 7 is a schematic view illustrating an exemplary process of mounting the development cartridge 300 in the mounting portion 201 after the photoreceptor cartridge 200 is mounted in the body 100, according to an embodiment of the present invention. While the photoreceptor cartridge 200 is mounted in the body 100, the development cartridge 300 may be drawn near the body 100 so that the first guide protrusion 310 is supported by the first guide rail 231. The development cartridge 300 may be pushed into the body 100. The first guide protrusion 310 approaches the first accommodation portion 241. As the development cartridge 300 is inserted into the body 100, the second guide protrusion 320 may be guided by the second guide rail 232, and the first and second guide protrusions 310 and 320 are respectively accommodated in the first and second accommodation portions 241 and 242.

When attaching/detaching directions of the development cartridge 300 and the photoreceptor cartridge 200 cross a transfer direction of the recording medium P, i.e., are a length direction of the photoconductive drum 1, the photoconductive drum 1 and the development roller 4 may interfere with other components in the body 100 or the development cartridge 300 and the photoconductive drum 1 may interfere with each other, and thus a risk of the photoconductive drum 1 and the development roller 4 being damaged may be high, while the development cartridge 300 and the photoreceptor cartridge 200 are attached to, or detached from, the body 100. According to the electrophotographic image forming apparatus of an exemplary embodiment, the mounting direction A1 and the removal direction A2 of the photoreceptor cartridge 200 and the development cartridge 300 are the transfer direction of the recording medium P. In other words, the mounting direction A1 and the removal direction A2 are a transverse direction crossing the length direction B of the photoconductive drum 1. According to an exemplary embodiment, the development roller 4 and the photoconductive drum 1 barely interfere with each other while mounting the development cartridge 300 in the mounting portion 201. Accordingly, a risk of damage caused by interference between the development roller 4 and the photoconductive drum 1 may be reduced.

Even when the development cartridge 300 is mounted in the mounting portion 201 of the photoreceptor cartridge 200 after the photoreceptor cartridge 200 is mounted in the body 100, the development cartridge 300 may not be fixedly combined to the photoreceptor cartridge 200. In other words, a user may remove the development cartridge 300 from the photoreceptor cartridge 200 and the body 100 by pulling the development cartridge 300 in a removal direction, without having to unlock the development cartridge 300 from the photoreceptor cartridge 200.

Referring to FIG. 4, a first handle 260 for the user to hold while mounting or removing the photoreceptor cartridge 200 in or from the body 100 may be provided in the photoreceptor cartridge 200. The first handle 260 may be located at the opening 101, i.e., at the rear of the photoreceptor cartridge 200, so as to be easily found by the user when the cover 400 is opened. For example, the first handle 260 may be provided at a center of the connecting member 250 connecting the first and second guide members 210 and 220.

Referring to FIG. 5, a second handle 360 for the user to hold while mounting or removing the development cartridge 300 in or from the body 100 may be provided in the development cartridge 300. The second handle 360 may be located at the opening 101, i.e., at the rear of the development cartridge 300 so as to be easily found by the user when the cover 400 is opened.

According to the electrophotographic image forming apparatus of the current embodiment, when the photoreceptor cartridge 200 and the development cartridge 300 are removed from the body 100, the development cartridge 300 may be first removed from the mounting portion 201 of the photoreceptor cartridge 200, and then the photoreceptor cartridge 200 may be removed from the body 100. Referring to FIG. 2B, the second handle 360 may be located above the first handle 260 while the photoreceptor cartridge 200 and the development cartridge 300 are mounted in the body 100. Generally, an eye level of the user is higher than the electrophotographic image forming apparatus. A line of sight of the user looking into the body 100 through the opening 101 while the cover 400 of the body 100 is opened may be from top to bottom. Thus, the second handle 360 above the first handle 260 may be more easily found by the user, and the user may first hold the second handle 360 and remove the development cartridge 300.

According to the electrophotographic image forming apparatus of an exemplary embodiment, the development cartridge 300 may be fixed to the photoreceptor cartridge 200 by pressurizing the development cartridge 300 in the mounting direction A1 by closing the cover 400.

Figure 8:
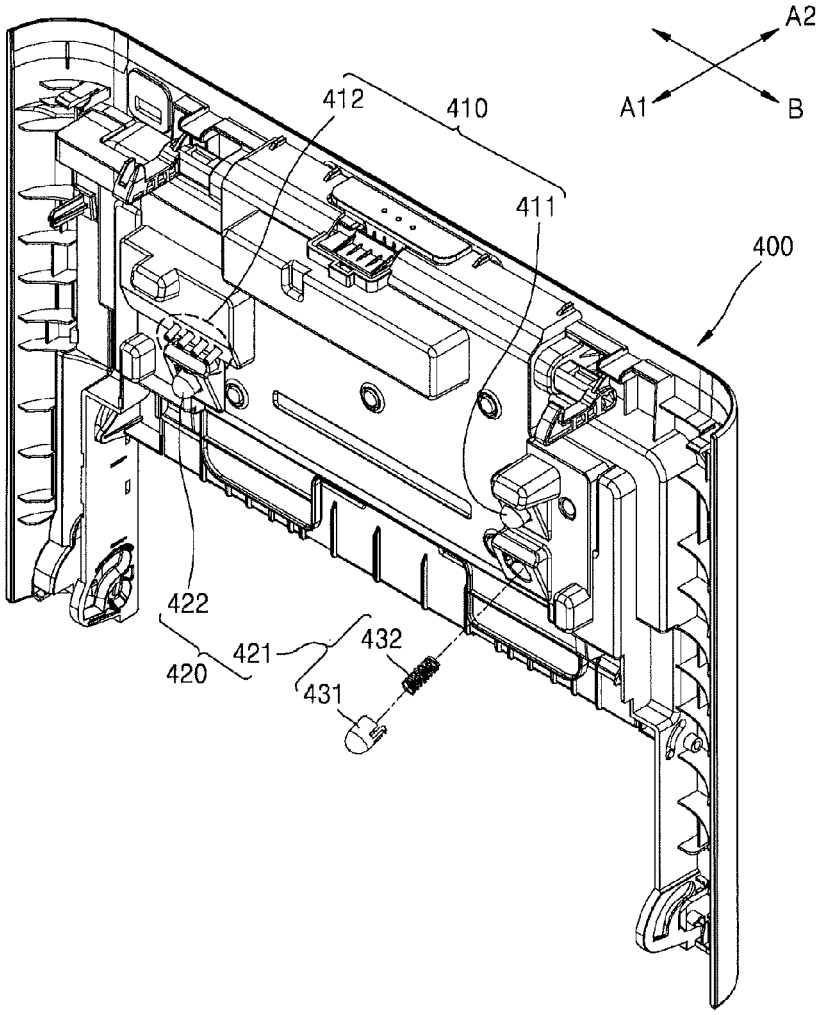
FIG. 8 is a perspective view of a cover according to an embodiment of the present invention.
Figure 9:
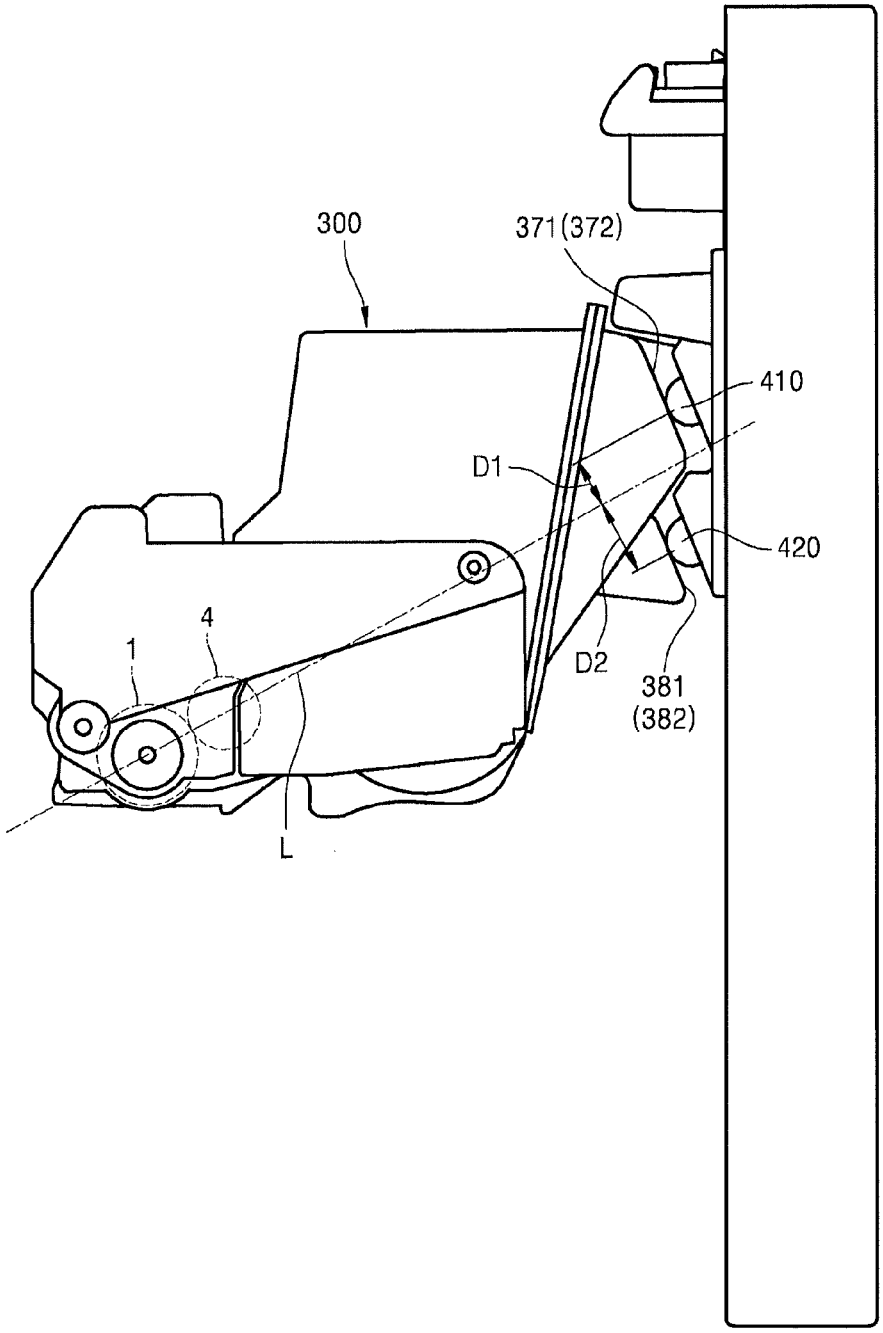
FIG. 9 is a side view illustrating a state of a development cartridge being pressurized by a pressurization portion while a cover is closed, according to an embodiment of the present invention.

FIG. 8 is a perspective view of the cover 400 according to an embodiment of the present invention. FIG. 9 is a side view illustrating a state of the development cartridge 300 being pressurized while the cover 400 is closed, according to an embodiment of the present invention. Referring to FIGS. 8 and 9, first and second pressurizing units 410 and 420 may be provided in the cover 400. The first and second pressurizing units 410 and 420 may be disposed opposite to each other based on a center line L. The first pressurizing unit 410 may be spaced apart from the center line L by a first distance D1 so as to apply first pressing force F1 to the development cartridge 300 when the cover 400 is closed. The second pressurizing unit 420 may be spaced apart from the center line L by a second distance D2 so as to apply second pressing force F2 to the development cartridge 300 when the cover 400 is closed. As illustrated in FIG. 5, the development cartridge 300 may include first and second pressure-receiving units 370 and 380 for respectively receiving the first and second pressing forces F1 and F2 of the first and second pressurizing units 410 and 420. The first pressurizing unit 410 includes a plurality of first pressurization portions, for example, two first pressurization portions 411 and 412 spaced apart from each other in the length direction B. The second pressurizing unit 420 includes a plurality of second pressurization portions, for example, two second pressurization portions 421 and 422 spaced apart from each other in the length direction B. Accordingly, referring to FIG. 5, the first and second pressure-receiving units 370 and 380 may include first pressure-receiving portions 371 and 372 and second pressure-receiving portions 381 and 382 respectively corresponding to the first pressurization portions 411 and 412 and the second pressurization portions 421 and 422. As such, by preparing the two first pressurization portions 411 and 412 and the two second pressurization portions 421 and 422, which are spaced apart from each other in the length direction B, so as to provide the first and second pressing forces F1 and F2 , the length direction B of the first and second pressing forces F1 and F2 may be easily balanced. Since sizes of pressing forces applied respectively by the first pressurization portions 411 and 412 and the second pressurization portions 421 and 422 may be reduced, stresses applied to the cover 400 and the development cartridge 300 may be reduced. The second pressurization portion 422 may also function as a second contact portion electrically connected to a first contact portion 391 (see, for example, FIG. 5) of a memory unit 390 provided in the development cartridge 300.

By fixing the development cartridge 300 to the mounting portion 201 by closing the cover 400, a locking apparatus, or the like, for fixing the development cartridge 300 to the photoreceptor cartridge 200 does not need to be separately provided at the development cartridge 300 or the photoreceptor cartridge 200, and thus material costs may be reduced. Since the combination of the development cartridge 300 and the photoreceptor cartridge 200 may be maintained/released only by opening and closing the cover 400, processes of mounting/detaching the development cartridge 300 and the photoreceptor cartridge 200 may be simplified, and thus user convenience may be improved. By dividing pressing force for pressurizing the development cartridge 300 into the first and second pressing forces F1 and F2 based on the center line L connecting the centers of the photoconductive drum 1 and development roller 4, positional stability of the development cartridge 300 may be improved by compensating for pushing force applied to the development cartridge 300 and a moment of rotation, thereby stably maintaining the development nip N.

The photoreceptor cartridge 200 and the development cartridge 300 are consumable products that may be distributed by being packaged separately from, or together with, an image forming apparatus. When the charging roller 2 and the photoconductive drum 1, and the photoconductive drum 1 and the development roller 4 contact each other, the charging roller 2 and the development roller 4 may be deformed during a distribution process. The photosensitive layer on a surface of the photoconductive drum 1 may be damaged as the elastic layers of the charging roller 2 and the development roller 4 are deteriorated. When the photosensitive layer is damaged, a printing defect, wherein lengthwise stripes are formed on a printed image, may be generated. Accordingly, a method of separating the charging roller 2 and the photoconductive drum 1 and the photoconductive drum 1 and the development roller 4 is required.

According to the electrophotographic image forming apparatus of an exemplary embodiment, the photoreceptor cartridge 200 and the development cartridge 300 may be individually replaced, and the development cartridge 300 may be mounted in the mounting portion 201 provided in the photoreceptor cartridge 200 while the photoreceptor cartridge 200 is mounted in the body 100. The photoreceptor cartridge 200 may include a first separating member (not shown) for separating the charging roller 2 and the photoconductive drum 1, and the development cartridge 300 may include a second separating member (not shown) for separating the photoconductive drum 1 and the development roller 4 when the development cartridge 300 is mounted in the mounting portion 201 of the photoreceptor cartridge 200. However, cost of components may increases since two separating members are required, and the user has to remove the first and second separating members respectively from the photoreceptor cartridge 200 and the development cartridge 300 before mounting the photoreceptor cartridge 200 and the development cartridge 300 in the body 100. Thus, according to the electrophotographic image forming apparatus of an exemplary embodiment, one separating member 500 of FIG. 10 may be used to separate the charging roller 2 and the photoconductive drum 1, and the photoconductive drum 1 and the development roller 4.

Figure 10:
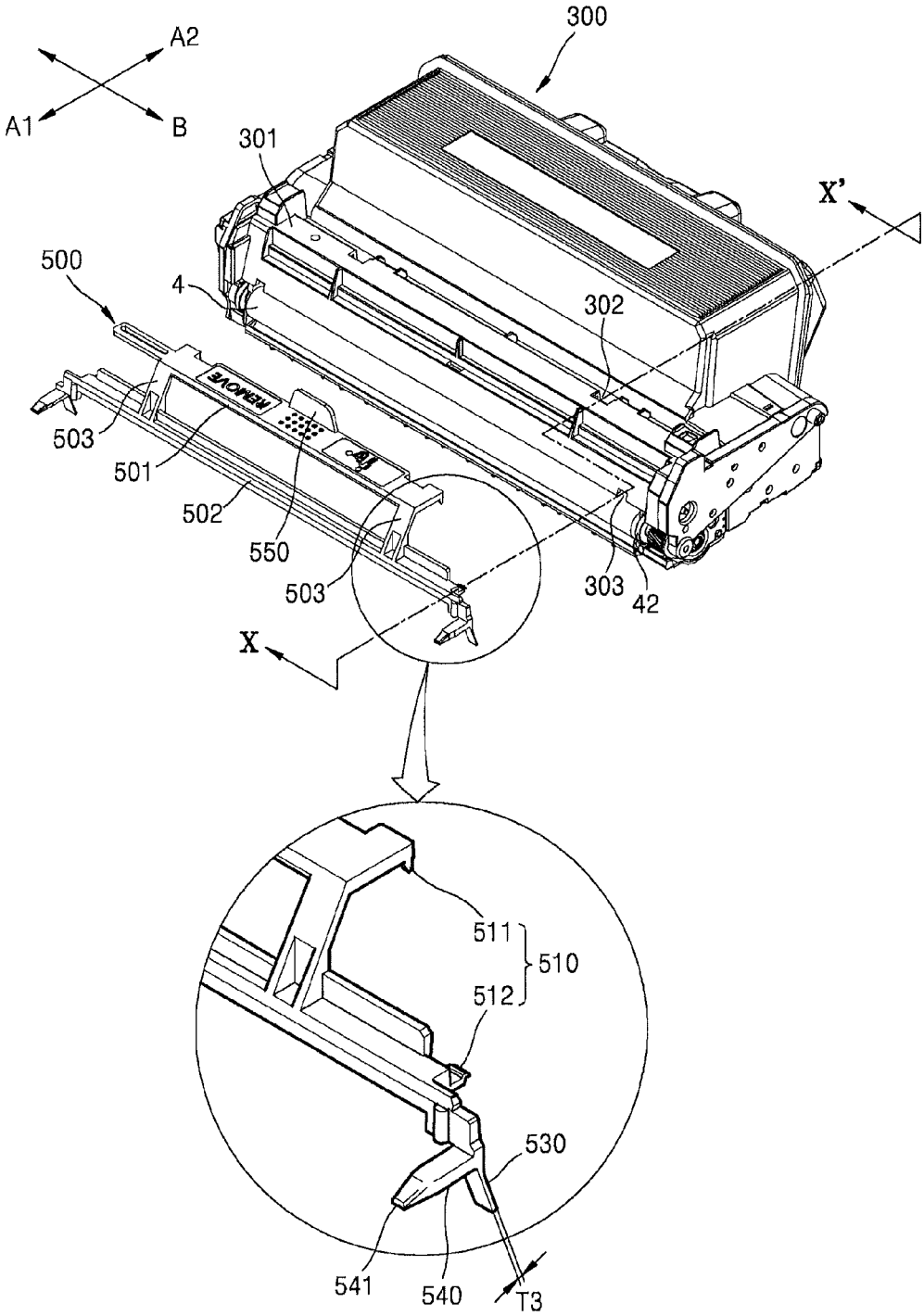
FIG. 10 is an exploded perspective view of a separating member according to an embodiment of the present invention.
Figure 11:
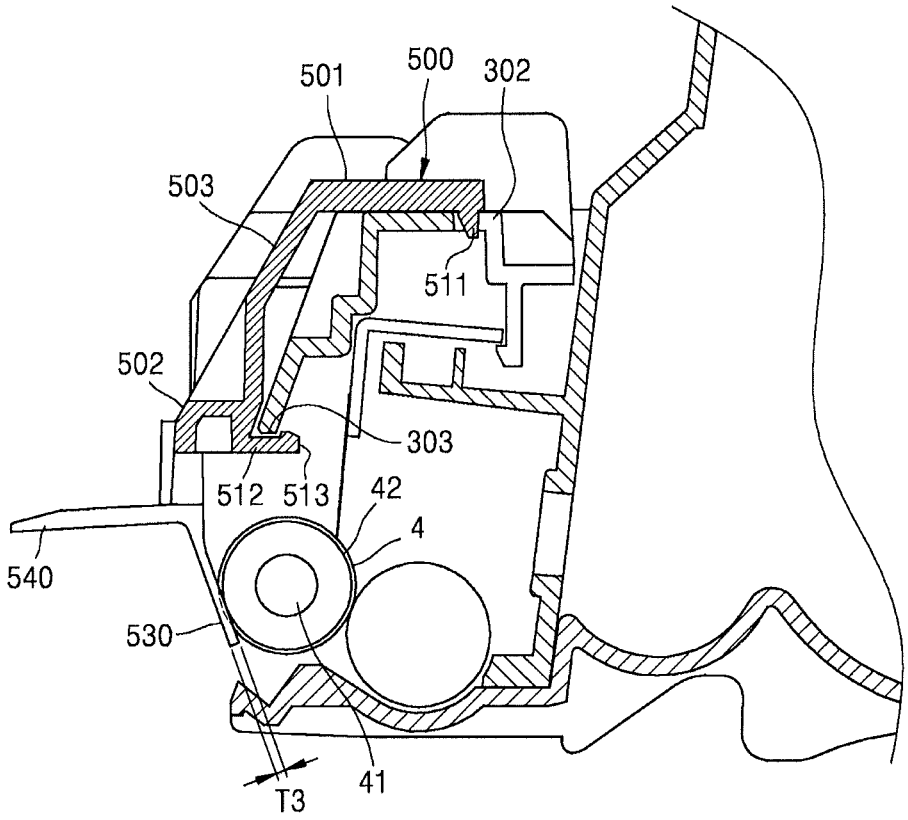
FIG. 11 is an exemplary cross-sectional view taken along line X-X' of FIG. 10.
Figure 12A:
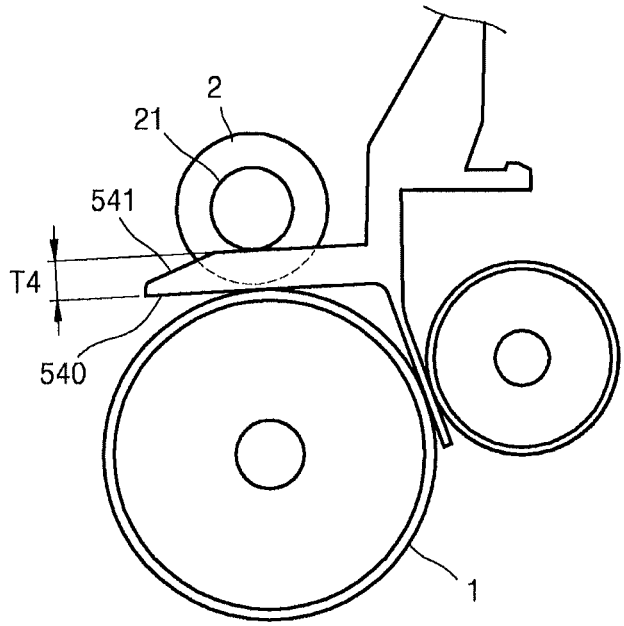
FIG. 12A illustrates an exemplary operation of a charging nip separating portion, according to an embodiment of the present invention.
Figure 12B:
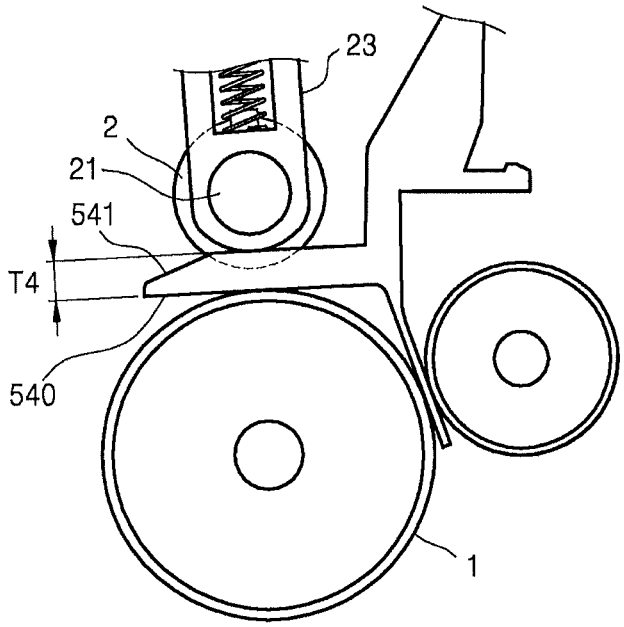
FIG. 12B illustrates an exemplary operation of a charging nip separating portion, according to an embodiment of the present invention.

FIG. 10 is an exploded perspective view of the separating member 500 according to an embodiment of the present invention. FIG. 11 is an exemplary cross-sectional view taken along line X-X' of FIG. 10. FIGS. 12A and 12B are side views for describing operation of a charging nip separating portion 540, according to an exemplary embodiment of the present invention.

Referring to FIG. 10, the separating member 500 includes a combining portion 510 joinable to the development cartridge 300, the development nip separating portion 530 disposed between the photoconductive drum 1 and the development roller 4 when the development cartridge 300 is mounted in the mounting portion 201, and the charging nip separating portion 540 disposed between the photoconductive drum 1 and the charging roller 2 when the development cartridge 300 is mounted in the mounting portion 201.

The separating member 500 may include a first body 501 accommodated in a housing 301 of the development cartridge 300, and a second body 502 connected to the first body 501 via a connecting arm 503. The first and second bodies 501 and 502 may have a bar shape extending in the length direction B. The first body 501 may be supported by a top surface of the housing 301 and the second body 502 may be disposed at a front portion of the housing 301, i.e., in front of the development roller 4. According to an embodiment, the combining portion 510 may join the separating member 500 to the development cartridge 300 via a snap-fit method. Referring to FIGS. 10 and 11, the combining portion 510 may include a first arm 511 provided at the first body 501, and a second arm 512 extending from the second body 502 and having a hook 513 at an end thereof. An accommodation portion 302 into which the first arm 511 is inserted, and a raised stopping portion 303 where the hook 513 of the second arm 512 is caught, may be provided at the housing 301 of the development cartridge 300. When the separating member 500 is mounted in the development cartridge 300, the first arm 511 is inserted into the accommodation portion 302, and the connecting arm 503 may elastically bend forward so that the hook 513 of the second arm 512 is caught at the raised stopping portion 303. When the separating member 500 is to be removed from the development cartridge 300, the separating member 500 may be slightly lifted upward, and tilted forward, such that the first arm 511 is separated from the accommodation portion 302 and then the hook 513 is released from the raised stopping portion 303.

Referring to FIGS. 10 and 11, two development nip separating portions 530 spaced apart from each other in the length direction B are illustrated. The two development nip separating portion 530 may be disposed outside an effective image region in the length direction B. The development nip separating portion 530 may be, for example, disposed at a front portion of the gap maintaining member 42. The development nip separating portion 530 may contact the gap maintaining member 42. Accordingly, when the development cartridge 300 is mounted in the mounting portion 201 of the photoreceptor cartridge 200, the development nip separating portion 530 is disposed between the photoconductive drum 1 and the gap maintaining member 42 such that the separating member 500 first contacts the photoconductive drum 1. Thus, the development cartridge 300 no longer moves in the mounting direction A1, and the development roller 4 and the photoconductive drum 1 may maintain a non-contact state. A thickness T3 of the development nip separating portion 530 may be larger than a contact thickness T1 of FIG. 3B between the development roller 4 and the photoconductive drum 1.

Referring to FIGS. 10 and 12A, two charging nip separating portions 540 spaced apart from each other in the length direction B are illustrated. The two charging nip separating portions 540 may be disposed outside the effective image region in the length direction B. The charging nip separating portion 540 may be inserted between the charging roller 2 and the photoconductive drum 1 to separate the charging roller 2 from the photoconductive drum 1 when the development cartridge 300 is mounted in the mounting portion 201 of the photoreceptor cartridge 200. For example, a leading end 541 of the charging nip separating portion 540 may have a wedge shape. A thickness T4 of the charging nip separating portion 540 may be suitably determined such that the charging roller 2 and the photoconductive drum 1 do not contact each other. As illustrated in FIG. 12A, the charging nip separating portion 540 may be inserted between the rotation shaft 21 of the charging roller 2 and the photoconductive drum 1. Alternatively, as illustrated in FIG. 12B, the charging nip separating portion 540 may be inserted between the photoconductive drum 1 and the shaft supporting member 23 supporting the charging roller 2 with respect to the frame 202.

Accordingly, since the development nip N and the charging nip C may be separated from each other by using one separating member 500 mounted in the development cartridge 300, material casts may be reduced.

Even when the photoreceptor cartridge 200 and the development cartridge 300 are mounted in the body 100, the charging roller 2 and the photoconductive drum 1, and the photoconductive drum 1 and the development roller 4 may be spaced apart from each other. Accordingly, since the electrophotographic image forming apparatus may be packed while the photoreceptor cartridge 200 and the development cartridge 300 are mounted in the body 100, packaging costs and distribution costs may be reduced. Moreover, since the charging roller 2, the development roller 4, and the photoconductive drum 1 may be prevented from being damaged during the distribution process of the electrophotographic image forming apparatus, the quality of the electrophotographic image forming apparatus may be maintained during the distribution process.

Before using the electrophotographic image forming apparatus, the user may open the cover 400 and separate the development cartridge 300 from the body 100. The charging nip C may be naturally formed between the charging roller 2 and the photoconductive drum 1 since the charging nip separating portion 540 is detached from between the photoconductive drum 1 and the rotation shaft 21 of the charging roller 2 or between the shaft supporting member 23 and the photoconductive drum 1. The user may remove the separating member 500 from the development cartridge 300, mount the development cartridge 300 again in the mounting portion 201 of the photoreceptor cartridge 200, and close the cover 400. Accordingly, the development cartridge 300 moves in the mounting direction A1 until the gap maintaining member 42 contacts the photoconductive drum 1, and the development nip N may be formed between the photoconductive drum 1 and the development roller 4.

A handle 550 for the user to hold may be provided at the separating member 500. Referring to FIG. 10, the handle 550 may, for example, protrude upward from the first body 501. The separating member 500 may be a color different from the development cartridge 300 so that the user easily recognizes that the separating member 500 is a component to be removed.

The photoreceptor cartridge 200 may be individually sold as a consumable product, and the charging roller 2 and the photoconductive drum 1 may be spaced apart from each other during the distribution process. Additional expenses may be generated if a separate separating member (not shown) for separating the charging roller 2 and the photoconductive drum 1 are employed. If the separating member 500 is combinable to the photoreceptor cartridge 200, a separate separating member for the photoreceptor cartridge 200 does not need to be provided.

Figure 13:
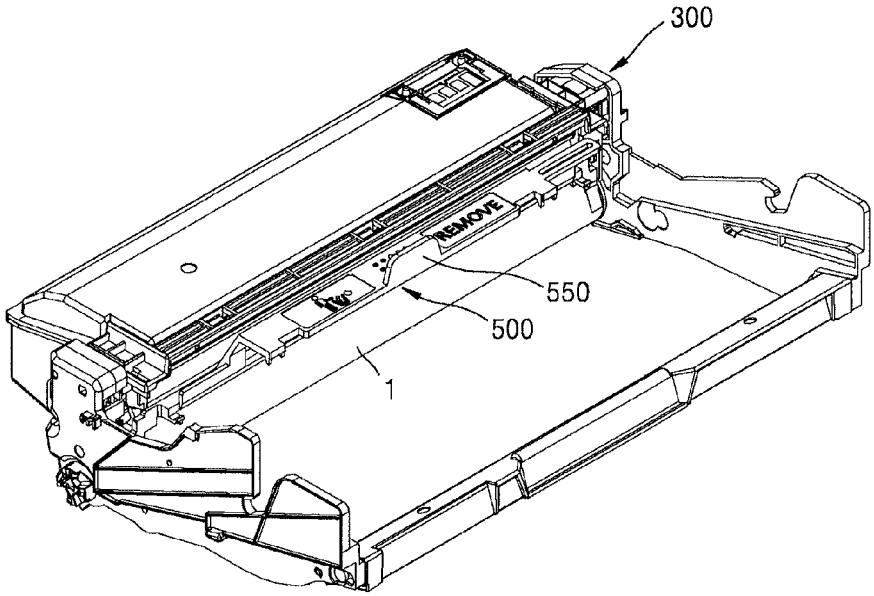
FIG. 13 is a perspective view of a separating member combined to a photoreceptor cartridge, according to an embodiment of the present invention.

FIG. 13 is a perspective view of the separating member 500 combined to the photoreceptor cartridge 200, according to an embodiment of the present invention. Referring to FIG. 13, the separating member 500 is combined to the photoreceptor cartridge 200. When the separating member 500 is combined to the photoreceptor cartridge 200 such that the charging nip separating portion 540 is inserted between the photoconductive drum 1 and the rotation shaft 21 of the charging roller 2 (see, for example, FIG. 12A) or between the shaft supporting member 23 and the photoconductive drum 1 (see, for example, FIG. 12B), the separating member 500 is combined to the photoreceptor cartridge 200 as illustrated in FIG. 13. The photoreceptor cartridge 200 may be packaged and individually sold in this state. The user who purchased the photoreceptor cartridge 200 may form the charging nip C by removing the separating member 500, and then mount the photoreceptor cartridge 200 in the body 100.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming apparatus comprising:

a body comprising an opening;

a photoreceptor cartridge attached to, or detached from, the body through the opening, and comprising a mounting portion, a photoconductive drum, and a charging roller, wherein the photoconductive drum and the charging roller form a charging nip by contacting each other;

a development cartridge attached to, or detached from, the mounting portion through the opening while the photoreceptor cartridge is mounted in the body, and comprising a development roller forming a development nip by contacting the photoconductive drum;

a cover for opening, or closing, the opening, and fixing the development cartridge to the mounting portion by pressurizing the development cartridge while the opening is closed; and a separating member mounted on the development cartridge, and comprising a development nip separating portion and a charging nip separating portion respectively separating the development nip and the charging nip while the development cartridge is mounted in the mounting portion, wherein when the development cartridge is mounted in the mounting portion, the charging nip separating portion is inserted between the charging roller and the photoconductive drum to separate the charging roller from the photoconductive drum.

2. The electrophotographic image forming apparatus of claim 1, wherein the development cartridge further comprises a gap maintaining member for constraining the development nip by contacting the photoconductive drum, wherein the development nip separating portion is disposed in front of the gap maintaining member and is disposed between the photoconductive drum and the gap maintaining member when the development cartridge is mounted in the mounting portion.

3. The electrophotographic image forming apparatus of claim 1, wherein the charging roller comprises a rotation shaft and a conductive rubber around the rotation shaft, and wherein the charging nip separating portion is inserted between a rotation shaft of the charging roller and the photoconductive drum to separate the charging roller from the photoconductive drum when the development cartridge is mounted in the mounting portion.

4. The electrophotographic image forming apparatus of claim 1, further comprising a shaft supporting member for rotatably supporting the charging roller with respect to a frame of the photoreceptor cartridge, wherein the charging nip separating portion is inserted between the shaft supporting member and the photoconductive drum to separate the charging roller from the photoconductive drum when the development cartridge is mounted in the mounting portion.

5. The electrophotographic image forming apparatus of claim 1, wherein the separating member comprises a combining portion separably combined to a housing of the development cartridge.

6. The electrophotographic image forming apparatus of claim 5, wherein the separating member comprises a handle for a user to hold.

7. A development cartridge mounted in a mounting portion of a photoreceptor cartridge comprising a photoconductive drum and a charging roller, which form a charging nip by contacting each other, while the photoreceptor cartridge is mounted in a body of an image forming apparatus, the development cartridge comprising:

a housing;

a development roller rotatably supported by the housing and forming a development nip by contacting the photoconductive drum while the development cartridge is mounted in the mounting portion; and a separating member comprising a combining portion combined to the housing, and a development nip separating portion and a charging nip separating portion respectively separating the development nip and the charging nip when the development cartridge is mounted in the mounting portion, wherein when the development cartridge is mounted in the mounting portion, the charging nip separating portion is inserted between the charging roller and the photoconductive drum to separate the charging roller from the photoconductive drum.

8. The development cartridge of claim 7, wherein the development cartridge further comprises a gap maintaining member for constraining the development nip by contacting the photoconductive drum, and the development nip separating portion is disposed in front of the gap maintaining member and is disposed between the photoconductive drum and the gap maintaining member when the development cartridge is mounted in the mounting portion.

9. The development cartridge of claim 8, wherein the charging roller comprises a rotation shaft and a conductive rubber around the rotation shaft, and wherein the charging nip separating portion is inserted between the rotation shaft of the charging roller and the photoconductive drum to separate the charging roller from the photoconductive drum when the development cartridge is mounted in the mounting portion.

10. The development cartridge of claim 8, wherein the charging nip separating portion is inserted between the photoconductive drum and a shaft supporting member that rotatably supports the charging roller with respect to a frame of the photoreceptor cartridge when the development cartridge is mounted in the mounting portion to separate the charging roller from the photoconductive drum.

* * * * *